US010249172B2

(12) United States Patent
Neravati et al.

(10) Patent No.: US 10,249,172 B2
(45) Date of Patent: Apr. 2, 2019

(54) WEARABLE DEVICE FOR SAFETY MONITORING OF A USER

(71) Applicant: M/s. Hug Innovations Corp., Cupertino, CA (US)

(72) Inventors: Raja Sekhar Neravati, Hyderabad (IN); Manohar Gangalakurti, Hyderabad (IN); Dileep Kumar Panjala, Hyderabad (IN)

(73) Assignee: M/s. Hug Innovations Corp., Cupertino, CA (US)

( * ) Notice: Subject to any disclaimer, the term of this patent is extended or adjusted under 35 U.S.C. 154(b) by 0 days.

(21) Appl. No.: 15/633,391

(22) Filed: Jun. 26, 2017

(65) Prior Publication Data

US 2017/0372592 A1 Dec. 28, 2017

Related U.S. Application Data

(60) Provisional application No. 62/355,284, filed on Jun. 27, 2016.

(51) Int. Cl.

| | |
|---|---|
| ***G08B 21/04*** | (2006.01) |
| ***G08B 25/00*** | (2006.01) |
| ***G08B 25/01*** | (2006.01) |
| ***G08B 25/08*** | (2006.01) |
| ***G08B 25/10*** | (2006.01) |
| ***G08B 27/00*** | (2006.01) |

(52) U.S. Cl.

CPC ..... *G08B 25/016* (2013.01); *G08B 21/0446* (2013.01); *G08B 21/0453* (2013.01); *G08B 21/0492* (2013.01); *G08B 25/001* (2013.01); *G08B 25/004* (2013.01); *G08B 25/08* (2013.01); *G08B 25/10* (2013.01); *G08B 27/008* (2013.01)

(58) Field of Classification Search

CPC .. G08B 25/016; G08B 21/0446; G08B 15/00; G08B 21/0211; G08B 21/043; G08B 21/0453; G08B 21/0492; G08B 25/001; G08B 25/004; G08B 25/10; G08B 27/008; H04B 1/385; H04B 17/27

See application file for complete search history.

(56) References Cited

U.S. PATENT DOCUMENTS

| | | | | |
|---|---|---|---|---|
| 8,249,547 | B1 | 8/2012 | Fellner | |
| 8,406,141 | B1 * | 3/2013 | Couturier | H04L 43/18 370/241 |
| 8,479,122 | B2 | 7/2013 | Hotelling | |
| 8,665,148 | B2 | 3/2014 | Hakim | |
| 8,670,979 | B2 | 3/2014 | Gruber | |
| 8,787,006 | B2 | 7/2014 | Golko | |
| 2008/0052313 | A1 * | 2/2008 | Keen | G06F 19/321 |

(Continued)

*Primary Examiner* — James J Yang
*Assistant Examiner* — Kevin Lau
(74) *Attorney, Agent, or Firm* — Laurence P. Colton; Smith Tempel Blaha LLC

(57) ABSTRACT

A precise, gesture-based, safety monitoring system, method and device. The present invention comprises a controller, wherein the controller upon detection of a distress signal, sends an alert signal along with the Location information of the user to a Remote Server. The Remote Server, upon receiving an alert signal sends an SMS and e-mail along with the Location information to a Mobile device of the registered emergency numbers of the user and responds in real-time.

13 Claims, 9 Drawing Sheets

(56) References Cited

U.S. PATENT DOCUMENTS

| | | | | |
|---|---|---|---|---|
| 2015/0100323 | A1* | 4/2015 | Kozuka | G06F 3/017 704/275 |
| 2015/0163311 | A1* | 6/2015 | Heath | G06Q 30/0201 709/204 |
| 2015/0279187 | A1* | 10/2015 | Kranz | G08B 21/0415 340/539.12 |
| 2015/0366518 | A1* | 12/2015 | Sampson | A61B 5/7221 600/301 |
| 2016/0091980 | A1* | 3/2016 | Baranski | A61B 5/0488 345/156 |
| 2016/0110055 | A1* | 4/2016 | Sullivan | G06F 17/30589 715/771 |
| 2016/0266606 | A1* | 9/2016 | Ricci | G06F 1/163 |
| 2017/0078435 | A1* | 3/2017 | Babol | H04L 67/2842 |
| 2017/0273116 | A1* | 9/2017 | Elghazzawi | H04W 76/007 |

* cited by examiner

WEARABLE DEVICE FOR SAFETY MONITORING OF A USER

STATEMENT OF RELATED APPLICATIONS

This patent application claims priority on and the benefit of U.S. Provisional Patent Application No. 62/355,284 having a filing date of 27 Jun. 2016.

BACKGROUND OF THE INVENTION

Personal safety is an important concern in our society. Individuals may face danger or emergency situations when they are in a home, workplace or while traveling. In emergency situations, such as an accident, heart attack, brain stroke, abduction or molestation, carrying a cell phone in hand and informing to his or her well-wishers becomes difficult for an individual.

To overcome the problem mentioned above, emergency alert devices were introduced. The emergency alert devices are popular among the elderly citizens who are subject to falling or suffering from strokes and heart attacks. In general, the existing emergency alert devices comprise a wearable device and a base unit. In emergency scenarios, the user presses a button on the wearable device, which sends a signal to the base unit. Here, the base unit has an automatic dialing feature and communicates a signal to a land-line of the house to a help desk. The usual protocol to deal with such a call by the help desk is that the help desk operator tries to communicate verbally with the user using the speakerphone feature of the base unit.

The main drawback associated with such emergency alert devices is that they have a wearable device and a base unit, which is remotely separated from the instrument. There may be scenarios in which the user may be severely injured to communicate with the help desk operator. Further, the speakerphone is placed at a single point in a dwelling, and if the user is away from the speakerphone, it is difficult for the user to communicate through the speakerphone with the help of the desk operator.

TECHNICAL FIELD

The present invention relates to a wearable device for safety monitoring of a user automatically or by using simple Hand Gestures by pressing SOS button by the user.

PRIOR ART

U.S. Pat. No. 8,249,547B1 (referred herein as '547) titled "Emergency alert device with mobile phone" discloses a wearable emergency alert device. "The wearable emergency alert device comprises a wearable member and a separately encased mobile phone member that is carefully attachable to the wearable member. In the case of emergencies, the user presses a button on the wearable member. When the user presses a button, a first transmitter present on the wearable member sends a signal to the mobile phone. The mobile phone on receiving the signal automatically dials a predefined emergency number. A drawback associated with the wearable emergency alert device as disclosed in '547 is that two sets of communication take place, one from the wearable member to the mobile phone and other from the mobile phone to a remote caretaker. Another drawback being, there may be scenarios in which the user is not in a position to press the button on the wearable device."

U.S. Pat. No. 8,787,006 B2 titled "Wrist-worn electronic device and methods thereof" discloses embodiments of electronic wristwatches. "An electronic wristband provides additional electrical circuitry or devices that can be made available for use as or with an electronic device. The electronic device can be a mobile device, removable coupled to an electronic wristband which provides additional circuitry or devices. Advantageously, the electronic device can apply the additional electrical circuitry or devices offered within the electronic wristband to supplement the capabilities of the electronic device. In another embodiment, the electronic device can be integrally formed with the electronic wristband which provides the additional circuitry or devices."

U.S. Pat. No. 8,479,122 B2 titled "Gestures for touch sensitive input devices" discloses methods and systems for processing touch inputs. "The invention in one respect includes reading data from a multipoint sensing device such as a multipoint touch display where the data relates to touch input with regard to the multipoint sensing device and identifying, at least one multipoint gesture based, on the data from the multipoint sensing device."

U.S. Pat. No. 8,665,148 B2 titled "Global positioning system receiver with phase offset compensation" discloses "the system that works based on, an electronic device such as a cellphone may include transceiver circuitry for managing wireless communications. The transceiver circuitry may consist of a transceiver such as a cellular telephone transceiver or a wireless local area network receiver and may include a satellite positioning system receiver. The radio-frequency circuitry may be used to pair the transceiver circuitry to antenna structures. When operating the transceiver in different modes of operation, the radio-frequency circuitry may be adjusted to enhance performance. Adjustments to the radio-frequency circuitry impose phase offsets on satellite positioning system signals received through the antenna structures and radio-frequency circuitry. The phase offsets which would otherwise produce degradation in the satellite positioning system receiver can be compensated by applying gathered compensating phase offset values to the satellite positioning system receiver during operation."

U.S. Pat. No. 8,670,979 B2 titled "Active input elicitation by intelligent automated assistant" discloses "methods, systems, and computer-readable storage medium related to operating an intelligent automated assistant. A user request is gathered through a conversation interface of the intelligent automated assistant, the user request including at least a speech input established from a user. One or more candidate domains relevant to the user request are identified from a plurality of pre-defined fields, where each pre-defined domain offers a respective area of service offered by the intelligent automated assistant, and the recognizing is based on respective degrees of match between words obtained from the user request and words representing vocabulary and entities related to each predefined domain. Feedback is provided to the user over the conversation interface of the intelligent automated assistant, where the opinion offers a paraphrase of the user request and elicits additional input from the user to specify one or more parameters connected with a particular candidate domain."

Therefore, there exists a need for an improved wearable device that monitors the safety of a user in a simplified manner, without much user intervention.

BRIEF SUMMARY OF THE INVENTION

The present invention overcomes the drawbacks of the prior art by providing a wearable device for safety monitoring of a user. For this purpose, the wearable device detects distress signal of the user either by pressing SOS button on the wearable device or by using simple Hand Gestures.

The wearable device mainly comprises a controller, wherein the controller, upon detection of a distress signal, sends an alert signal along with the location information of the user to a Remote Server. The Remote Server, upon receiving an alert signal sends an SMS and e-mail along with the location information to all the well-wishers who have been included in the registered list of the user.

The location information is sent to the mobile device of the registered emergency numbers of the user. The wearable device of the present invention further comprises an assisted GPS module or uses GPS on the paired cell phone to get an accurate location of the user. Upon receiving distress signal, the controller triggers the GPRS module to send the location it has received from the assisted GPS module to the Remote Server.

A distress signal is generated in the following situations, detection of a distress Gesture, pressing of a distress button continuously for more than few seconds, forceful removal of the wearable device and accident detection or free fall and fatigue detection of the user.

The wearable device allows the user to define Gestures to control any electronic device such as a mobile phone, media player, VR controllers, laptop, etc.

Thus, the wearable device of the present invention automatically or on detection of simple Hand Gestures pre-configured by the user generates an alert signal to be transferred to the registered emergency numbers of the user.

This invention is gesture-based system having, (a) a Wearable comprising a Wearable and a Mobile application, (b) Location services comprising Location services and a Location processor, (c) Services C comprising a Redis cluster, an Application Gateway, User services, Health Services and Safety Services, and (d) Customer services, comprising a Customer Service Relationship (CSR) office, Website, CSR Services with Site-to-site (STS) VPN and a Load Balancer with data processing apparatus programmed to perform precise safety monitoring operations comprising, detecting one or more user inputs from the wearable A and performing measurements, triggering one or more SOS signals based on the user input, communicating between the wearable and services, initiating the SOS after eliminating false alarms, and detecting the user's location and contacting safety services and responding in real-time. The system further comprising (a) Service Bus Queues, (b) a SQL Database, (c) Solar search Engine, (d) Mongo Database, (e) Telephony services, (f) Notification services, and (g) one or more Load Balancers. The SQL Database feeds User data such as the registered well-wisher's details, local emergency contacts, to enable an efficient system performance. The Solar search Engine and Redis cluster are assimilated into the system. The services requested are lined-up and processed by the Service Bus Queues. The Telephony services and Notification services which can be used by a User accordingly as and when required either to alert their network members or to dismiss the alert signal generated during an emergency. Dismissal of an SOS triggered during an emergency is done through either a Call-center or a Mobile application, which will be dealt with the CSR office.

The Wearable has a cover, side keys, a laser etching, a heart-rate monitor, a charging port, a controller, a mobile device, a Remote Server, a battery, an SOS battery, distress signal, a display, a vibration motor, 9-axis inertial measurement unit (IMU), one or more alert signals, a Bluetooth and, a processor. Additionally, a GPS sensor and a GSM modem are available in the Wearable that works independently. The vibration motor is located away from the 9-axis inertial measurement unit and is configured as a silent alarm using a vibration module such that the motor configured to vibrate upon generation of a distress Gesture to indicate to the user that the alert signal has been sent to registered emergency numbers of the user. The alert signal from the user is in the form of Gestures, and the IMU is utilized to get 3D position and orientation of the wearable device that aids in extracting meaningful Gestures. The IMU acts as a high accuracy motion tracking unit to recognize Gestures and is of small size with low power consumption, comprises of a 3-axis accelerometer, 3-axis gyroscope, and 3-axis magnetometer, thus with 9 degrees of freedom. Hand Gestures are tracked by the 3-axis accelerometer and gyroscope from which alphabets are created for the Gestures, each alphabet represents a particular action and configured by the user using either the Bluetooth or a web-based application. The 3-axis accelerometer measures the acceleration of the user, whereas, the 3-axis magnetometer measures magnetic field associated with the user's change of orientation. The 3-axis gyroscope along with the 3-axis accelerometer is utilized for precise determination of an orientation of the user. The 9-axis inertial measurement unit automatically identifies a type of distress by calculating the change of orientation of the user from the 3-axis accelerometer, the 3-axis gyroscope, and the 3-axis magnetometer. To reduce false activations which might be performed while performing daily activities, an activation Gesture is performed by the user to activate the actual Gestures pre-configured by the user. The controller is a microcontroller which is capable of storing necessary instructions required for generating distress signal and for transmitting an alert signal along with location information of the user to the Remote Server and it co-ordinates various modules in the wearable device and initiates different modules based on the Gestures recognized by the IMU, and executes necessary actions including Gesture recognition, configuration, communication, and storage. The display screen is either a light-emitting diode (LED) Screen or an organic light-emitting diode (OLED) or liquid crystal display (LCD), used to indicate various information such as time and notifications.

In the present invention, there are two categories of a Companion model exist including a mobile device and being a GSM and GPS-enabled model in the case of the absence of the mobile device. The wearable allows the user to pre-configure one or more Gestures such that, they can control any electronic device, and the user can configure Gestures in an x-y plane, x-z plane and also with varying angular velocities, upon detection of an activation Gesture followed by the Gesture hit in the x-y plane, x-z plane or with varied angular velocity pre-configured by the user, the controller activates action associated with the pre-configured Gesture set by the user.

A computer-implemented method comprising the steps of, detecting one or more user input from a wearable device including, (a) button press, (b) force detection, (c) Auto-accident Collision detection, (d) stress and fatigue detection, and (e) Hand Gestures, performing one or more measurements based on the user's input by detecting a button press, enabling force detection, measuring IMU Sensor data, and detecting patterns from Hand Gestures, triggering SOS based on the user input, communicating between the wearable device and the Remote Server, initiating the SOS by the Remote Server, verifying a false alarm, calculating Location and contacting emergency services and dismissing the SOS triggered by a user. The step of performing measurements is discussed. For a button press input, pressing a SOS button present in the wearable device, verifying a period of button press by the controller, further, pressing the button for longer than one second vibrates the wearable and triggers the SOS, and pressing the button for a period less than one second, awaits SOS button press again. For a force detection, enabling force detection, triggering a Proximity Sensor upon enabling the force detection, measuring Proximity value by the Proximity Sensor and checking a position of the wearable device, vibrating the wearable device and initiating of the SOS, if the wearable device is not attached to a user's wrist, and monitoring Proximity value and attachment of the wearable device to the wrist, in the case of the wearable device safely attached to the user's wrist. For an Auto-accident Collision detection, enabling force detection, measuring G-Force value from a Sensor on receiving the user input, enabling vibrate mode of the wearable device thus initiating the SOS once the G-Force value exceeds a threshold value, and non-initiating the action for G-Force value lesser than the threshold value. For a stress and fatigue detection, measuring an IMU Sensor data on detection of the fall of a user, measuring the Proximity if there is a fall detected, else step 'i' is repeated, measuring the Heart Rate Monitor (HRM) data if the Wearable is attached to the wrist else no action is taken, vibrating the Wearable if the HRM data is not stable and initiating the SOS, else starting the timer for sixty seconds and if moving of the user is detected, then no action is taken, moving of the user when not detected, Wearable is vibrated and initiating the SOS. For Hand Gestures, oscillating of hand by the user for a configurable number of times continuously, and detecting a pattern of Hand Gesture by the wearable device, comparing a pattern detected by the Sensor with a user-defined pattern which are pre-defined by the user, and vibrating the Wearable and sending notifications to raise SOS, if the pattern of Hand Gesture is valid, else no action is taken.

The step of communicating between the wearable device and the Remote Server, further comprises, receiving an SOS by the wearable device, transmitting the signals to Remote server via cellular network, when the Wearable has connectivity, saving the SOS and waiting till connectivity is back, when no connectivity in wearable device, if a mobile device is present in the system then receiving an SOS by the wearable device, transmitting the signals to the Remote server through the Mobile, when the Wearable has connectivity, and saving the SOS and waiting till connectivity is back, when no connectivity in wearable device. Further, receiving the signals by the Remote Server, and initiating the SOS by the Remove Server.

The process of verifying a false alarm includes, checking the User's preferences by the controller, verifying the false alarm before raising the SOS and ends when identifies a false alarm, and confirming SOS situation by the controller to the Remote Server to send let or long every Q (configurable) seconds to the Remote Server, if there is no false alarm. Calculating Location and contacting emergency services is by creating a dynamic URL by the Remote Server to track the User. Calculating the nearest R (configurable) Users within S (configurable) meters radius of the Proximity from an incident Location by the Remote Server. Sending the alert signals by the Remote Server to well-wishers, nearest R Users, and emergency services. Dismissing the SOS signals further comprises, confirming the information to the well-wishers, even when the user is fine, then the user dismiss the SOS alerted, and initiating the dismissal of SOS either by calling the customer service or by using the mobile application, after taking user input. Dismissal of SOS by calling the customer service is by initiating a call to a Customer service by the User and providing authentication details to a Customer Service Representative (CSR), a session remains active for invalid authentication. Triggering a dismissal of the session by the CSR by sending a notification to the Remote Server upon successful authentication, thus ending transmit of the Location and disabling the session in the Remote Server. Sending an SMS and E-mail by the Remote Server to the Registered users and to those whom earlier the alert signal was forwarded, confirming the safety of the affected user and ending the process. Dismissal of SOS through the Mobile Application is by selecting an "I am Safe" option in the mobile application to dismiss the SOS alert initiated, that requires entering a Passcode to enable, the dismissal could not be initiated until a valid Passcode is provided, sending a notification to the Remote Server which stops to transmit the Location and disables the session in the Remote Server and initiating an SMS and E-mail by the Remote Server to all those who were alerted earlier to inform about the safety of the affected user and ending the process. A process of the triggered SOS signal to protect an affected user further comprises, communicating with the Remote Server by the wearable device, receiving the SOS at the wearable device and forwarding the same to the Remove Server via cellular network if wearable has connectivity. If no connectivity in the wearable then saving the SOS and waiting till the connectivity is back. If a mobile device is present in the system, then receiving the SOS at the wearable device and forwarding the same to the Remote Server through the mobile device if wearable has connectivity, and if no connectivity in the wearable then saving the SOS and waiting till the connectivity is back. Receiving signals by the Remote Server and initiating the SOS. Triggering of SOS to process the alert signal. Verifying for false alarm by the controller begins by checking the user's preference provided for "verify for false alarm before raising SOS". Confirming the SOS situation to the Remote Server directly if the user does not prefer for any verification, else further comprises: Initiating IVR call to check false SOS for a configurable number of times if not answered for first time. Prompting the user to enter a Passcode if the call is answered to ensure that the user is in real trouble, a valid Passcode indicates no harm to the user, and hence the process ends ignoring the SOS trigger. Confirming the SOS situation to the Remote Server for an invalid Passcode entry. Forwarding SOS notification to the Remote Server and sending either a Let or Long every configurable second to the Remote Server continuously. Calculating the Location and contacting of emergency services includes creating a dynamic URL by the Remote Server to track the user and, also calculating the nearest R configurable users within configurable meters radius of Proximity from the incident Location, sending an alert signal by the Remote Server to Registered well-wishers and nearest R users in a network and local Emergency services, the Remote Server sends only basic details but not entire details while alerting nearest R users if they are not part of the affected user's network, to avoid any unnecessary trouble to the user during an emergency or later, refreshing the Location by the Remote server based on the input received from the wearable device time-to-time and identifying the network type of the users as 3G, 4G, Edge or SMS by the Remote Server to forward the details. Further, forwarding real-time Location for 3G, 4G users, and 2G users receive the Location with slow refresh, receiving of SMS Location for users without 3G, 4G and 2G, which undergoes Cell triangulation and showing the nearest Proximity based on available Cell Tower, and monitoring continuously for the signal of those users who do not come under any of the above-mentioned network facility to whom the Location could not be shared, on identifying the signal performs a check for network identification and forwarding the details accordingly. The wearable device allows the user to pre-configure one or more Gestures such that, they can control any electronic device, and the user can configure Gestures in an x-y plane, x-z plane and also with varying angular velocities, upon detection of an activation Gesture followed by the Gesture hit in the x-y plane, x-z plane or with varied angular velocity pre-configured by the user, the controller activates action associated with the pre-configured Gesture set by the user.

A precise, gesture-based, safety monitoring wearable device for a user having, (a) a cover 1, (b) side keys, (c) a laser etching 3, (d) a heart-rate monitor 4, (e) a charging port 5, (f) a controller, (g) a mobile device, (h) a Remote Server, (i) a battery, (j) an SOS battery, (k) distress signal, (l) a light emitting diode (LED), (m) a vibration motor, (n) 9-axis inertial measurement unit (IMU), (o) one or more alert signals, (p) a Bluetooth and, (q) a processor. Additionally, a GPS sensor and a GSM modem are available in the Wearable that works independently. The cover is located on top front portion. The laser etching, the heart-rate monitor and the charging port are on the backside of the wearable device. The battery is molded into a design for maximum safety. The SOS battery reserve is used to send the distress signal. The light emitting diode has a TFT display screen to display time under normal operating conditions. The vibration motor is located away from the 9-axis inertial measurement unit and is configured as a silent alarm using a vibration module such that the motor configured to vibrate upon generation of a distress Gesture to indicate to a user that the alert signal has been sent to registered emergency numbers of the user. The alert signal from the user is in the form of Gestures, and the IMU is utilized to get 3D position and orientation of the wearable device that aids in extracting meaningful Gestures. The controller is a microcontroller which is capable of storing necessary instructions required for generating distress signal and for transmitting an alert signal along with location information of the user to the Remote Server and it co-ordinates various modules in the wearable device and initiates different modules based on the Gestures recognized by the IMU, and executes necessary actions including Gesture recognition, configuration, communication and storage. The IMU acts as a high accuracy motion tracking unit to recognize Gestures and is of small size with low power consumption, comprises of a 3-axis accelerometer, 3-axis gyroscope, and 3-axis magnetometer, thus with 9 degrees of freedom. Hand Gestures are tracked by the 3-axis accelerometer and gyroscope from which alphabets are created for the Gestures, each alphabet represents a particular action and configured by the user using either the Bluetooth or a web-based application. The 3-axis accelerometer measures acceleration of the user, whereas, the 3-axis magnetometer measures magnetic field associated with the user's change of orientation. The 3-axis gyroscope is used along with the 3-axis accelerometer for more precise determination of an orientation of the user. The 9-axis inertial measurement unit automatically identifies a type of distress by calculating the change of orientation of the user from the 3-axis accelerometer, the 3-axis gyroscope, and the 3-axis magnetometer. To reduce false activations which might be performed while performing daily activities, an activation Gesture is performed by the user to activate the actual Gestures pre-configured by the user.

A future version of the device contains an OLED display and an LED display. The wearable device allows the user to pre-configure one or more Gestures such that, they can control any electronic device and the user can configure Gestures in an x-y plane, x-z plane and also with varying angular velocities, upon detection of an activation Gesture followed by the Gesture hit in the x-y plane, x-z plane or with varied angular velocity pre-configured by the user, the controller activates action associated with the pre-configured Gesture set by the user.

BRIEF DESCRIPTION OF THE DRAWINGS

FIG. 2A shows the wearable device with a Cover.

FIG. 2B shows the side view of the wearable device.

FIG. 2C shows the back view of the wearable device.

FIG. 2D shows the full front perspective view of the wearable device.

FIG. 2E shows the full back perspective view of the wearable device.

DETAILED DESCRIPTION OF THE PREFERRED EMBODIMENTS

The present invention relates to a wearable device for safety monitoring of a user. The wearable device upon detection of a distress signal sends an alert signal along with the location data to the registered emergency numbers of the user. Here, the distress signal is generated either upon detection of a distress Gesture, upon pressing a distress button continuously by the user for a certain period, upon forceful removal of the wearable device, upon accident detection or free fall detection of the user.

Figure 1:
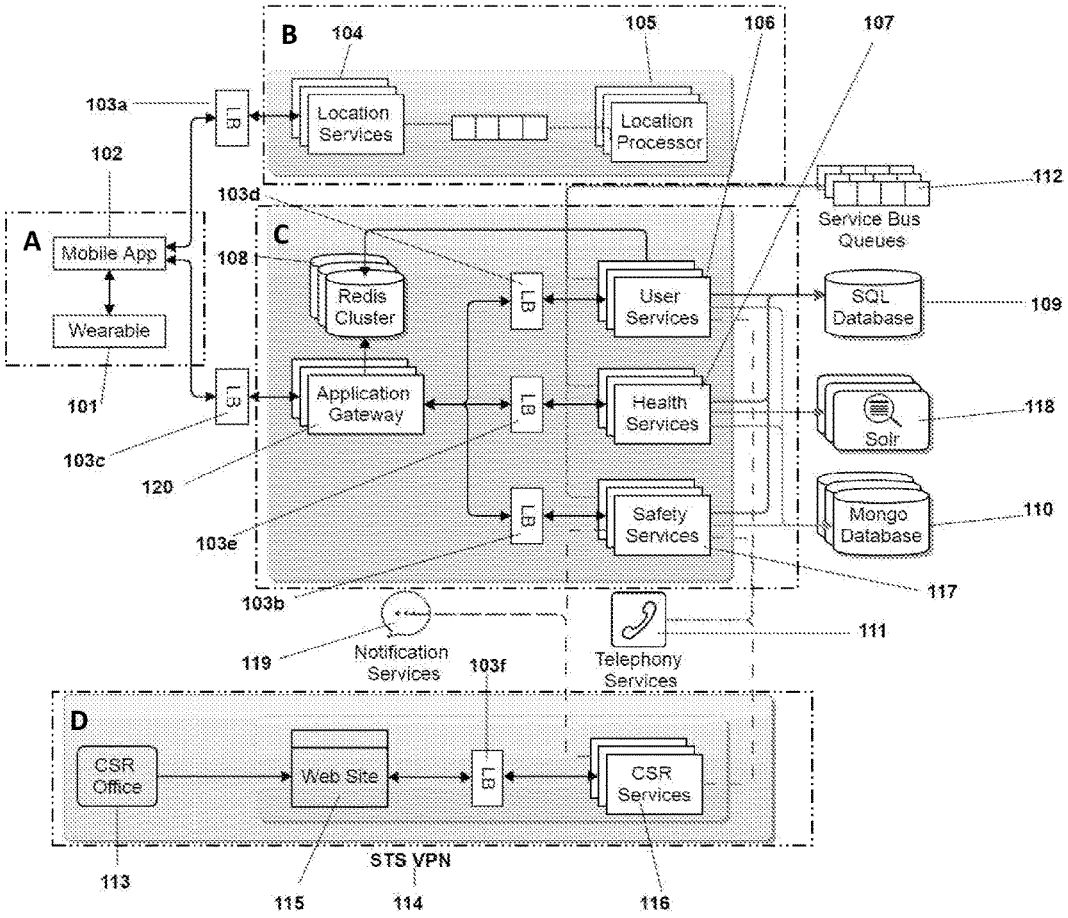
FIG. 1 shows the overall system of the present invention.

FIG. 1 is the overall system diagram of the present invention that consists of a Wearable A, Location services B, Services C, Customer services D, Service Bus Queues 112, a SQL Database 109, Solar search Engine 118, Mongo Database 110, Telephony services 111, Notification services 119, and one or more Load Balancers. The Wearable A includes a Wearable 101 and a Mobile application 102 which are integrated via Load Balancers 103*a*, 103*b*, 103*c*, 103*d*, 103*e* with different services like, user services 106, Health Services 107 and Safety Services 117 through an Application Gateway 120. The Location services B consists of Location services 104 and a Location processor 105. The Services C comprises Redis cluster 108, an Application Gateway 120, user services 106, Health Services 107 and Safety Services 117. A Customer Service Relationship (CSR) office 113, Website 115, CSR Services 116 forms the Customer services D with Site-to-site (STS) VPN 114 for a secured connection across multiple locations and a Load Balancer 103*f* integrating the Website 115 and CSR Services 116. The services requested are queued 112 and processed accordingly. There are also Telephony services 111 and Notification services 119 which can be used by a user subsequently as and when required either to alert their network members or to dismiss the alert generated during an emergency. The Location Monitor in the system consists of Location services 104 which are connected to a Location processor 105 the data is communicated between the Mobile Application 102 through the Load Balancer 103*a*. A SQL Database 109 feeds the user data such as the registered well-wisher's details, local emergency contacts, etc., to the system to enable an efficient system performance. The system is connected to a Solar search Engine 118. The Mongo Database 110 and Redis cluster 108 assimilated into the system to enhance the overall functioning. The Customer services D is connected by Site-to-site (STS) VPN 114, thus establishes a secure connection within.

The system further includes a Customer Service Relationship (CSR) office 113 which is through a Website 115, integrated to the CSR Services 116 through a Load Balancer 103*f*. The dismissal of the SOS triggered during an emergency is done through a Call-center or a Mobile application which will be dealt with the CSR office 113.

Figure 2A:
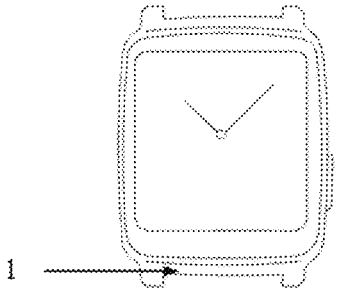
FIGS. 2A-2E show the components of the wearable device of the present invention.
Figure 2B:
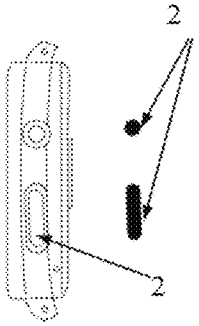
Figure 2C:
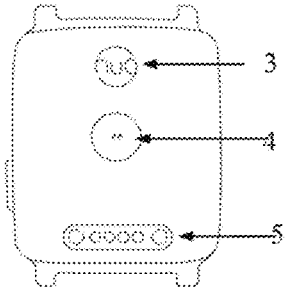
Figure 2D:
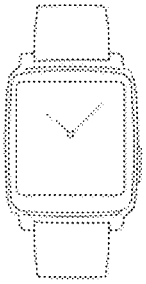
Figure 2E:
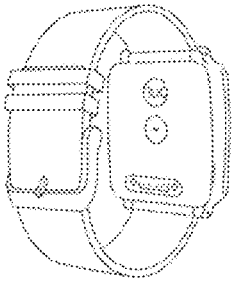

FIGS. 2A-2E show the different views of the wearable device. Top view of the device with a Cover 1 is illustrated in FIG. 2A, FIG. 2B gives the side view with side keys 2. At the back side of the wearable device, a laser etching 3, a heart-rate monitor 4 and a charging port 5 are located as shown in FIG. 2C. The full front perspective view and the back view of the wearable device are shown in FIGS. 2D and 2E respectively.

The wearable device comprises a controller, wherein the controller upon detection of a distress signal, transmits an alert signal to a paired Mobile. The Mobile then along with the Location information of the user forwards it to a Remote Server. The Remote Server, upon receiving an alert signal sends an SMS and e-mail along with the Location information to the Mobile device of the registered emergency numbers of the user.

The controller is a microcontroller and is capable of storing necessary instructions required for generating distress signal and for transmitting an alert signal along with the Location information of the user to the Remote Server.

The wearable device of the present invention comprises a 360 mah battery, which is molded into the design for maximum safety. The wearable device further manages to hold a small reserve as SOS battery, wherein the SOS reserve battery is used to send the distress signal.

The wearable device further comprises a small 2 cm×2 cm organic light emitting diode (OLED) or LCD with a TFT display screen to display time under normal operating conditions.

The wearable device also comprises a small vibration motor, wherein the low vibration motor is located away from the 9-axis inertial measurement unit. The small vibration motor backs a background noise of 28 Db @ 10 cm. The small vibration motor may be configured as a silent alarm using a vibration module.

The low vibration motor is also configured to vibrate upon generation of distress Gesture as an indication to the user that the alert signal has been sent to the registered emergency numbers of the user.

The alert signal from a user will be in the form of Gestures and to recognize the Gestures a high accuracy motion tracking device with small size and low power consumption is required. The inertial measurement unit (IMU) satisfies the requirements and is mainly used to get 3D position and orientation of the device. This information is used for extracting meaningful Gestures.

Figure 3:
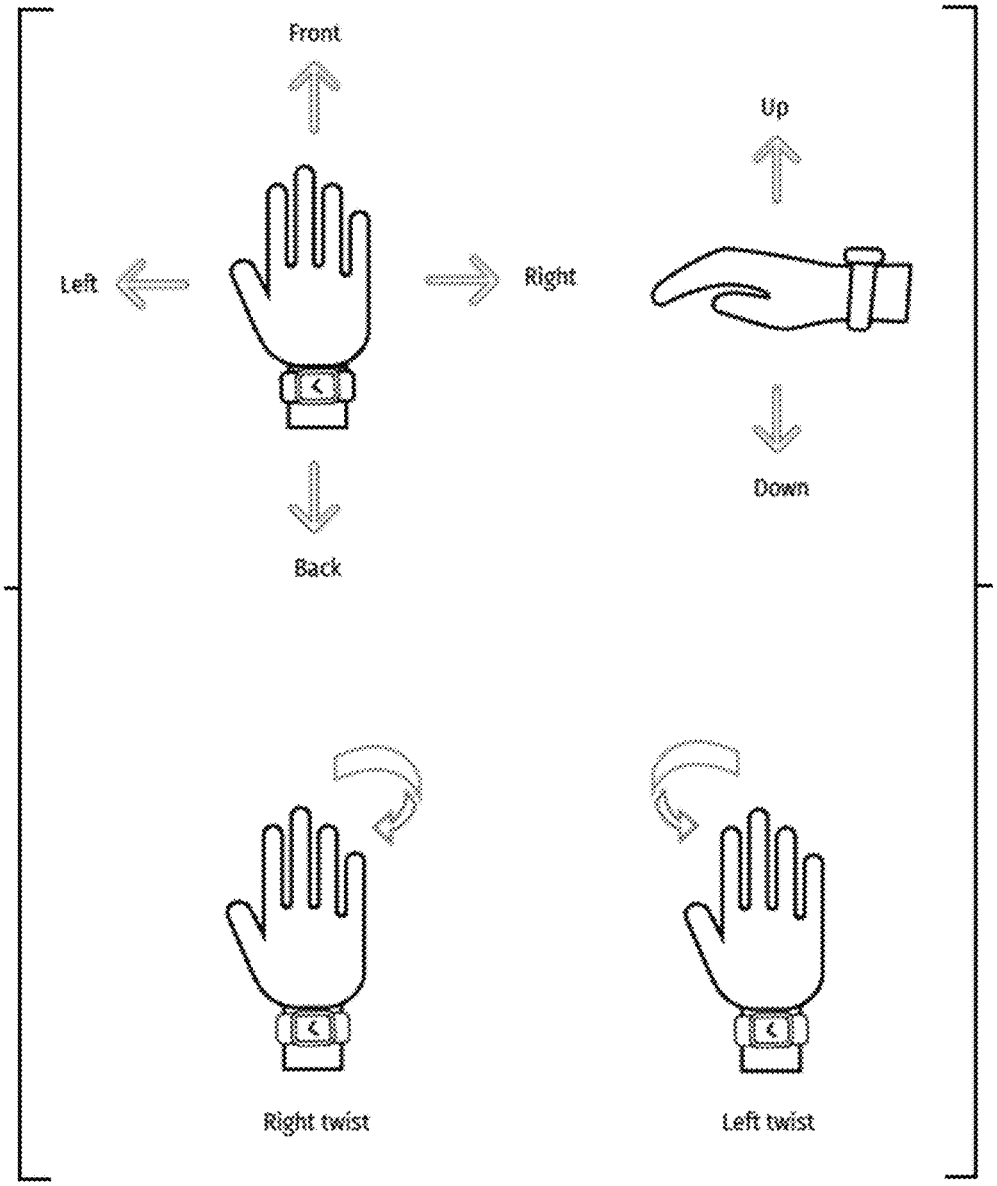
FIG. 3 shows the eight types of Hand Gestures.

The IMU consists of a 3-axis accelerometer, 3-axis gyroscope, and 3-axis magnetometer. Hence, the device is with 9 degrees of freedom. The Hand Gestures are tracked by the 3-axis accelerometer and gyroscope. Alphabets are created for the Gestures, each alphabet represents a particular action and configured by the user using the Bluetooth or a web-based application. FIG. 3 shows the eight types of Hand Gestures.

The 3-axis accelerometer measures the acceleration of the user. Similarly, the 3-axis magnetometer measures a magnetic field associated with the user's change of orientation. Here, the 3-axis gyroscope is used along with the 3-axis accelerometer for more precise determination of the orientation of the user. The 9-axis inertial measurement unit automatically identifies the type of distress by calculating the change of orientation of the user from the 3-axis accelerometer, the 3-axis gyroscope, and the 3-axis magnetometer. However, in order to reduce false activations which might be performed while performing daily activities, an activation Gesture is made by the user to activate the actual Gestures pre-configured by the user.

The wearable device of the present invention allows the user to configure Gestures in an x-y plane, x-z plane and also with varying angular velocities. Upon detection of an activation Gesture followed by the Gesture hit in the x-y plane, x-z plane or with varied angular velocity pre-configured by the user, the controller activates action associated with the pre-configured Gesture set by the user. For example, the user may set a Gesture such as rotate clockwise in the x-y plane to activate the photo burst mode in a Mobile camera using the Bluetooth module of the wearable device.

The small vibration motor embedded in the device away from the IMU is used for the silent alarm, Gesture detection, and notification alerts without much distraction to the user. Vibrations for notifications can be customized, and an alarm can be set, using the Bluetooth.

The controller communicates with the various modules in the device and initiates different modules based on Gestures recognized by the IMU. The controller performs necessary actions like recognizing the Gestures and starting GSM module to keep track of the Gestures configured for each action and also acts as a communicator. Additional memory can be added along with this processor.

For configuring the device, communication with an external device is required and is done by the Bluetooth. Thus, the communications with various Bluetooth enabled clients can be facilitated. The primary function of the Bluetooth is to configure Gestures.

The display screen used in the device can be a light-emitting diode (LED) Screen or an organic light-emitting diode (OLED) or liquid crystal display (LCD). The display is used to indicate information such as time and notifications. A flexible, less weight and low power display are used to suit the device. An OLED or LCD display works without a backlight.

The future version of the wearable device might contain OLED or LED display. In low ambient light conditions such as a dark room, an OLED screen can achieve a higher contrast ratio on LCD. The response time of OLED PLED is better than that of LED screens. OLED screens have better power efficiency and thickness than LCD screen. For cost effectiveness, LED screens can be used.

Figure 4A:
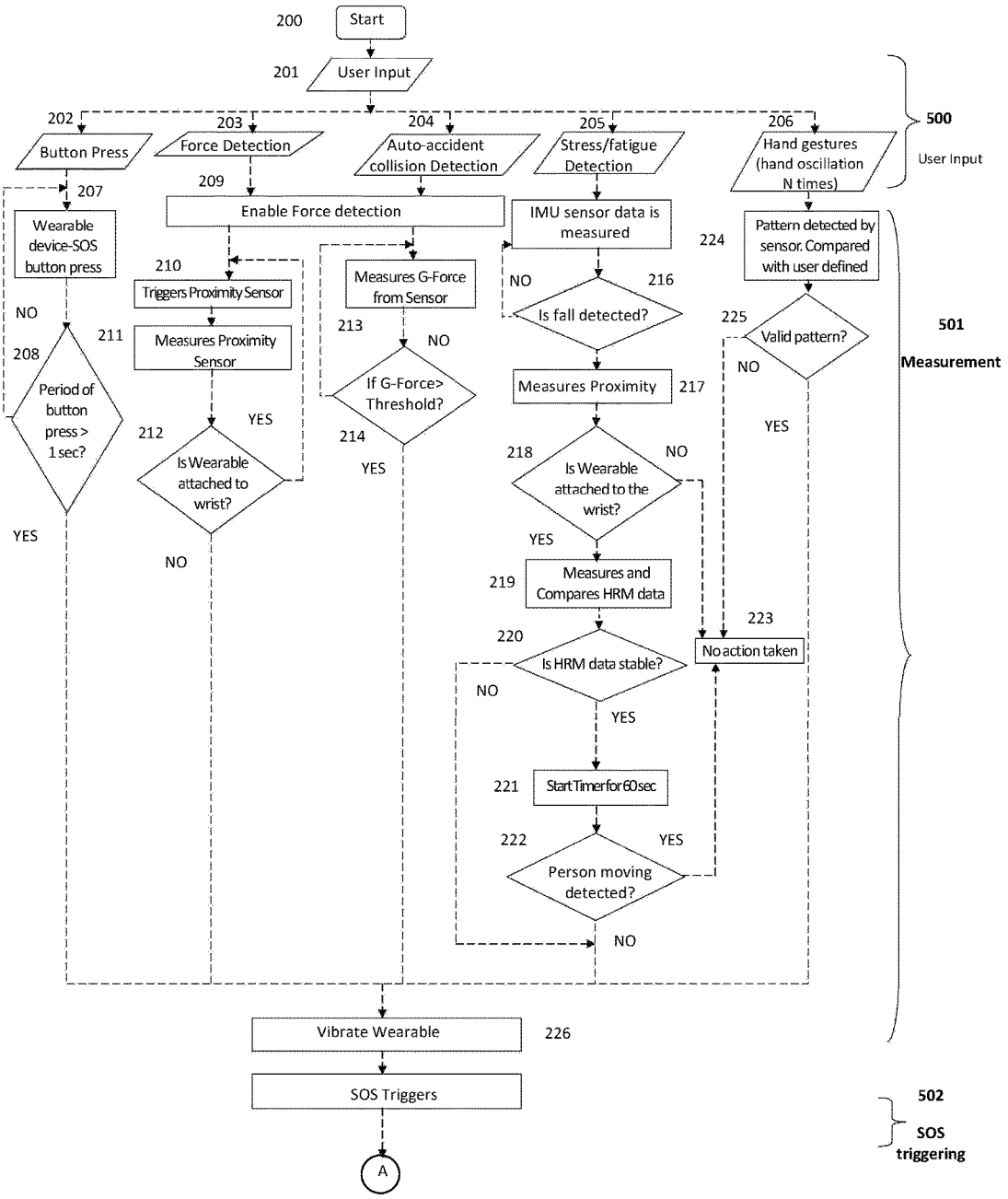
FIGS. 4A and 4B show the overall process of the present invention.
Figure 4B:
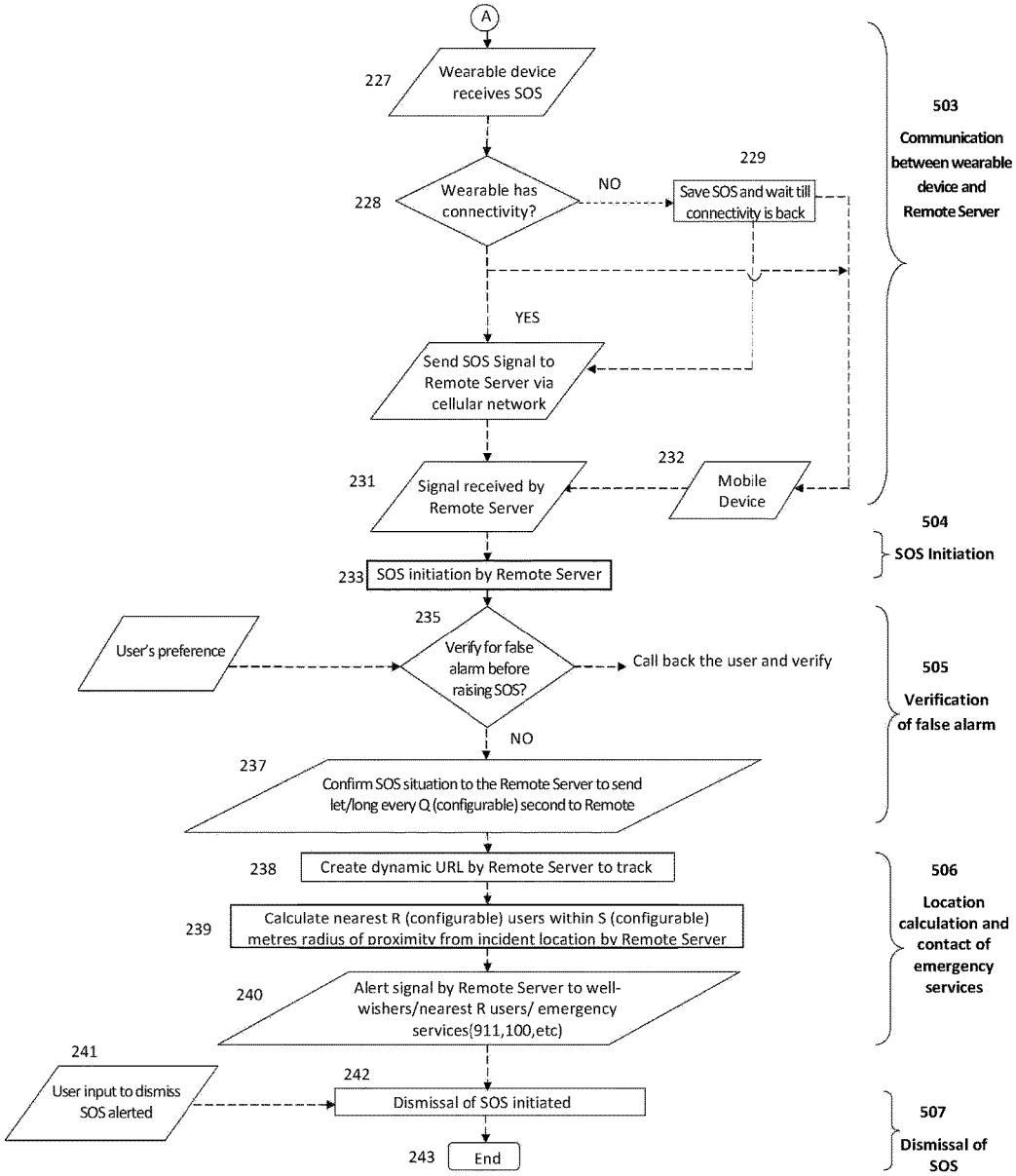

FIG. 4 shows the overall process of the present invention that involves, detecting one or more user input 500, measuring one or more user input 501 and identifying different forms, triggering SOS based on the user input 502, communicating between the wearable device and the Remote Server 503, initiating the SOS 504 by the Remote Server, verifying a false alarm 505 by taking user input, calculating Location and contacting emergency services 506, and dismissing the SOS triggered 507 by the user. The process starts 200 with the inputs 201 being measured by the various Sensors and compared by the controller with the user-defined values or results.

The detection of user input 500 which are of various forms such as, button press 202, force detection 203, Auto-accident Collision detection 204, stress and fatigue detection 205, and Hand Gestures 206.

The different types of inputs are measured 501 for identifying the different forms to trigger.

When the input is of button press 202, the user presses the SOS button 207 which is present in the wearable device and the controller estimates the period of the button press 208. If the button is pressed longer than one sec 208, the wearable vibrates 226 and then triggers the SOS 502, else no action is taken.

For force detection 203, the user enables the force detector 209 which triggers the Proximity Sensor 210. The Proximity value generated from the Proximity Sensor is measured 211, and the position of the wearable device is verified by the controller for attachment with a user's wrist 212. If the wearable device is not attached to the user's wrist, the wearable vibrates 226 and triggers the SOS 502. The Proximity value 211 and the attachment of the wearable device to the user's wrist 212 are continuously monitored in the case of the wearable device safely attached to the user's wrist.

The wearable device measures the G-force 213 once the force detector is enabled for Auto-accident Collision detection input 204. The G-force value is measured 213 with the help of the Sensor, and the controller compares the measured G-force with the threshold value. If the G-Force value exceeds the threshold value 214, then the vibrate mode of the wearable device 226 is enabled thus initiating the SOS 502.

Further, the IMU Sensor data is measured 215 to be aware of any fall detection of the user for stress and fatigue detection 205. The Proximity is measured 217 upon detection of fall of the user 216, and the association of the wearable device to the user's wrist is verified 218. If the wearable device is attached to the wrist, then the Heart Rate Monitor (HRM) data is measured and checked for stability 219. The stability of HRM 220 data is detected by comparing the measured data with the previous history of Heart Rate of the user. If the HRM data is unstable, then the wearable device vibrates 226 to send the SOS trigger 502. Stability of HRM data initiates a Timer for 60 seconds 221 and then detects movement of the user 222. Upon no movement of the user though with stable HRM data, the wearable device vibrates 226 and initiates SOS trigger 502. If the movement is detected after 60 seconds, then no action is taken 223.

When the user input 201 is a Hand Gestures 206 which are hand oscillations for a configurable number of times continuously. The patterns are detected by the Sensors and compared with the user patterns 224 which are pre-defined by the user. If the detected patterns are valid 225, then the wearable device vibrates 226 and sends the notification to trigger the SOS 502, if not no action is taken 223. The general pattern of the Hand Gestures is illustrated in FIG. 3.

Once the SOS is triggered 502 by the measured aspects 501 carried with respect to the user inputs 500, the wearable device communicates with the Remote Server 503 by receiving the SOS 227. If the wearable has connectivity 228, then signals are transmitted to the Remote Server via cellular network 230. The SOS is saved and waits till the connectivity is back 229 in the case of the Wearable without connectivity. The signal is sent through the Mobile device 232 to the Remote Server 231, if one is present within the system. The Mobile device also processes the signal based on the connectivity of the wearable 228, saves the SOS and waits for the connectivity to be back 229 during a no connectivity situation, to forward the signal to the Remote Server. Receiving signals by the Remote Server 231, from the Wearable either via a cellular network or through the Mobile device, if present. The SOS is initiated 233 by the Remote Server.

Once the SOS is initiated 504, the controller check for the user's preference 234 to verify for false alarm 235. If the user had preferred to verity for false alarm before raising the SOS then the initiate a call back to the user and verify 236. Otherwise, the controller confirms the SOS situation to the Remote Server and sends the Let or Long every Q (configurable) second to the Remote Server 237.

The Remote Server starts determining the Location of the wearable device and if needed contacts the emergency services 506 as soon as the SOS is initiated 504, and the alarm is proven to be factual 235. The Remote Server creates a dynamic URL to track the user 238. The nearest R (configurable) users within S (configurable) meters radius of Proximity from the incident Location is calculated 239 by the Remote Server. Upon establishing the Location of the user along with the wearable device, the Remote Server sends an alert 240 about the Location and status of the user to either the well-wishers or nearest R users or emergency services (911, 100, etc.).

If the information is conveyed to the well-wishers even when the user is fine, then the user dismisses 241 the SOS alert 507. The SOS initiated is dismissed 242 either by calling the customer service or by using the Mobile application, and the process ends 243.

Figure 5A:
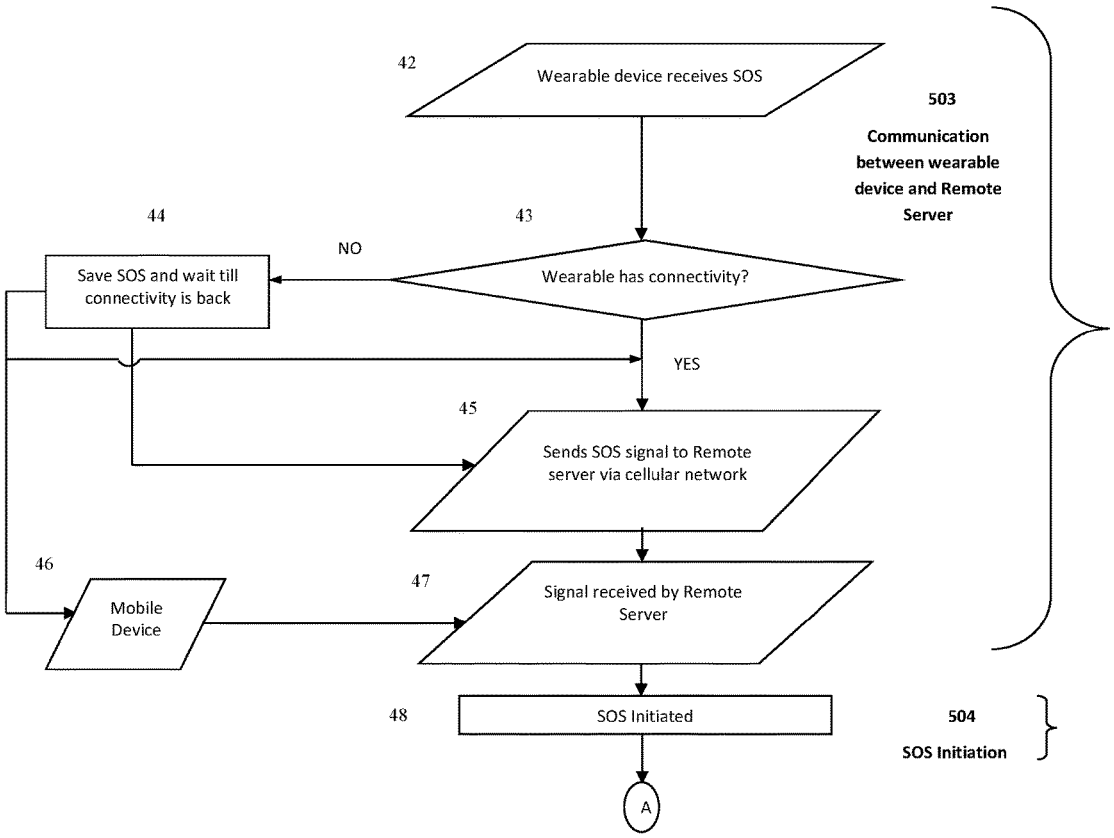
FIGS. 5A, 5B, and 5C show the workflow of SOS signal process in detail.
Figure 5B:
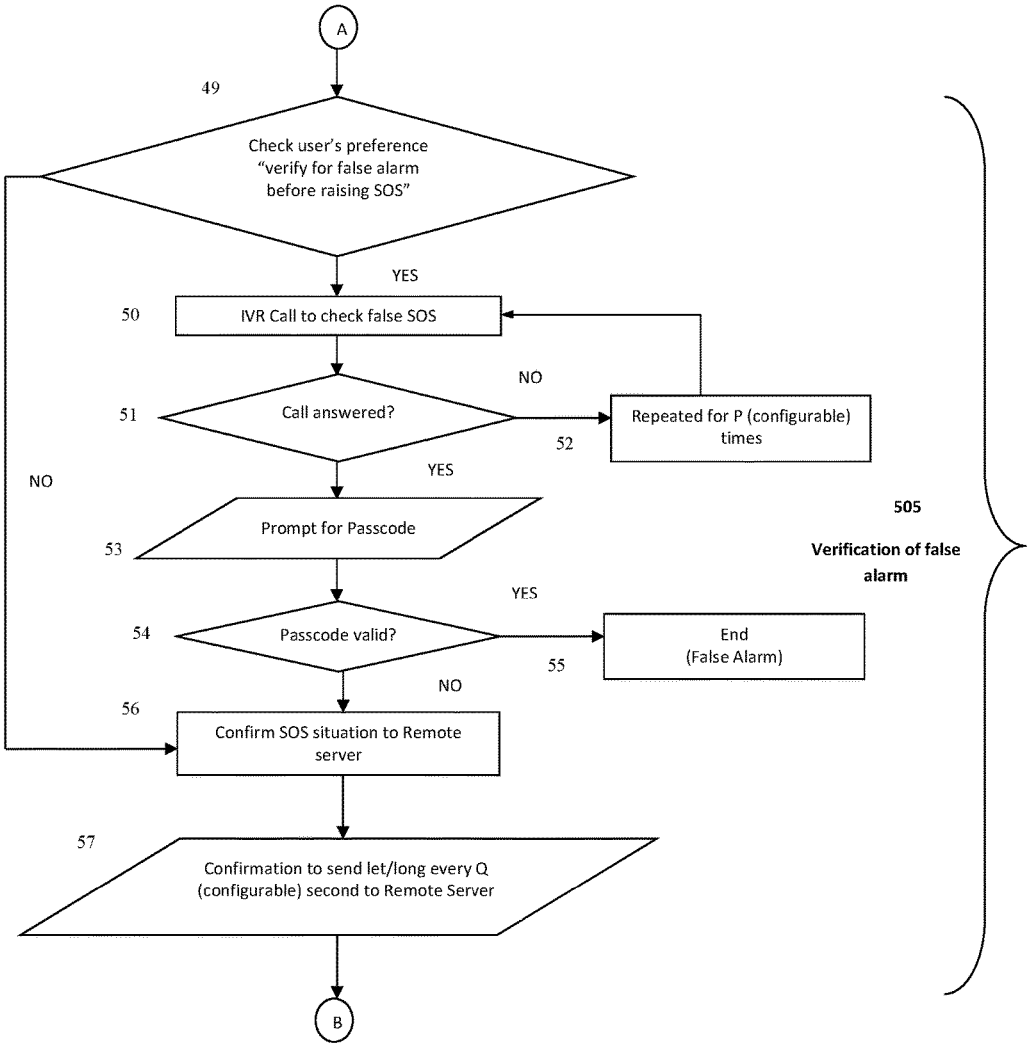
Figure 5C:
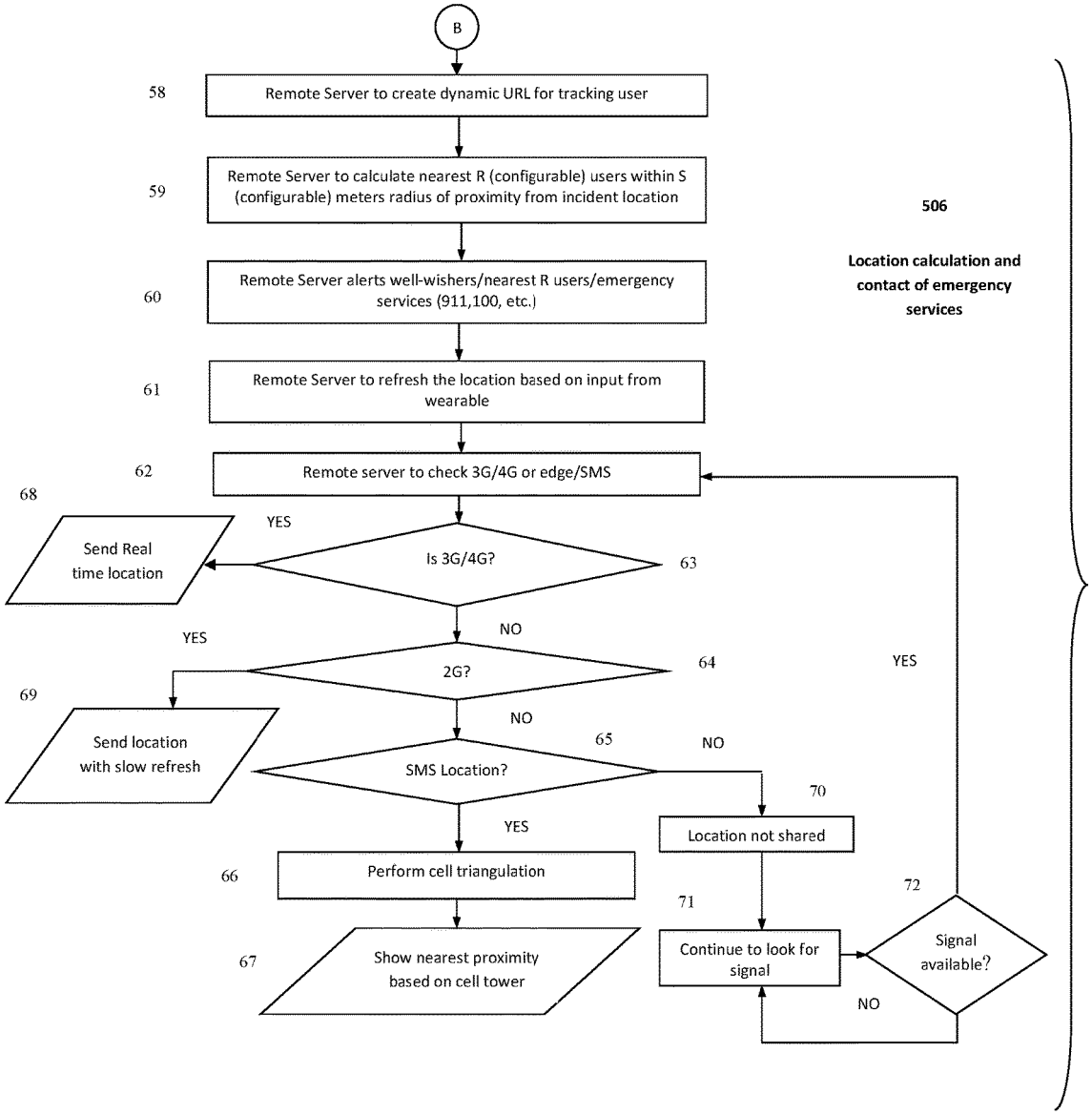

FIG. 5 shows the method of the triggered SOS signal process to protect the affected user. Initially, the wearable device communicates with the Remote Server 503. The wearable device on receiving the SOS 42 forwards the same to the Remove Server via cellular network 45 if the wearable has connectivity 43. In the case of no connectivity in the wearable device, saves the SOS 44 and waits till the connectivity is back. If a Mobile device 46 is present within the system, the Remote Server receives the SOS signal from the wearable device through the Mobile device if there is connectivity 43 in the wearable device and saves the SOS 44, waits for connectivity to be back to proceed further. The signal is received by the Remove Server 47 which initiates the SOS 48.

The SOS is triggered 504 to process the alert signal. Before proceeding to process the SOS, the controller verifies for false alarm 505. The controller checks user's preference for "verify for false alarm before raising the SOS" 49. If the user preference is to verify before raising the SOS, then an IVR call is initiated 50, and repeated for configurable P number of times 52, if not answered for the first time 51. If the call is answered then, the user is prompted to enter the Passcode 53 which is validated 54 to ensure that the user is in real trouble. A valid Passcode is an indication of no harm to the user but reveals a false alarm. Hence, the process ends ignoring the SOS trigger 55. An invalid Passcode 54 confirms the SOS situation to the Remote Server 56 and a confirmation is sent on every Q seconds to the Remote Server. For a user preference not set for any verification, the SOS situation is directly confirmed to the Remote Server 56 by sending the confirmation to send Let and Long every Q seconds to the Remote Server 57.

The process of Location calculation and contact of emergency services 506 begins as the Remote Server creates a dynamic URL 58 to track the user, and calculate the nearest R (configurable) users within S (configurable) meters radius of Proximity from the incident Location 59. An alert signal is sent by the Remote Server to the well-wishers, nearest R users in the network and the local Emergency services like 911, 100 in India 60.

While sending the alert signal to the nearest ten users who are not within the affected user network or the well-wisher list, the Remote Server sends only the basic details but not the full details, thus avoid any unnecessary trouble to the user during the emergency or later. The Remote Server refreshes the Location 61 based on the input received from the wearable device time-to-time. The network type of the users as 3G and 4G, Edge or SMS is identified by the Remote Server 62, and the details are forwarded accordingly. For 3G and 4G users 63, the real-time Location will be transmitted 68, and 2G users 64 receive Location with slow refresh 69. Those users without 3G, 4G, and 2G receive SMS Location 65 which undergoes Cell triangulation 66 and shows the nearest Proximity based on the Cell Tower 67. Those, users who do not come under any of the above-said network facility, the Location is not shared 70 but looks out for signal continuously 71 and when the Signal is identified 72, performs the check of network identification and forwards the details accordingly.

Figure 6:
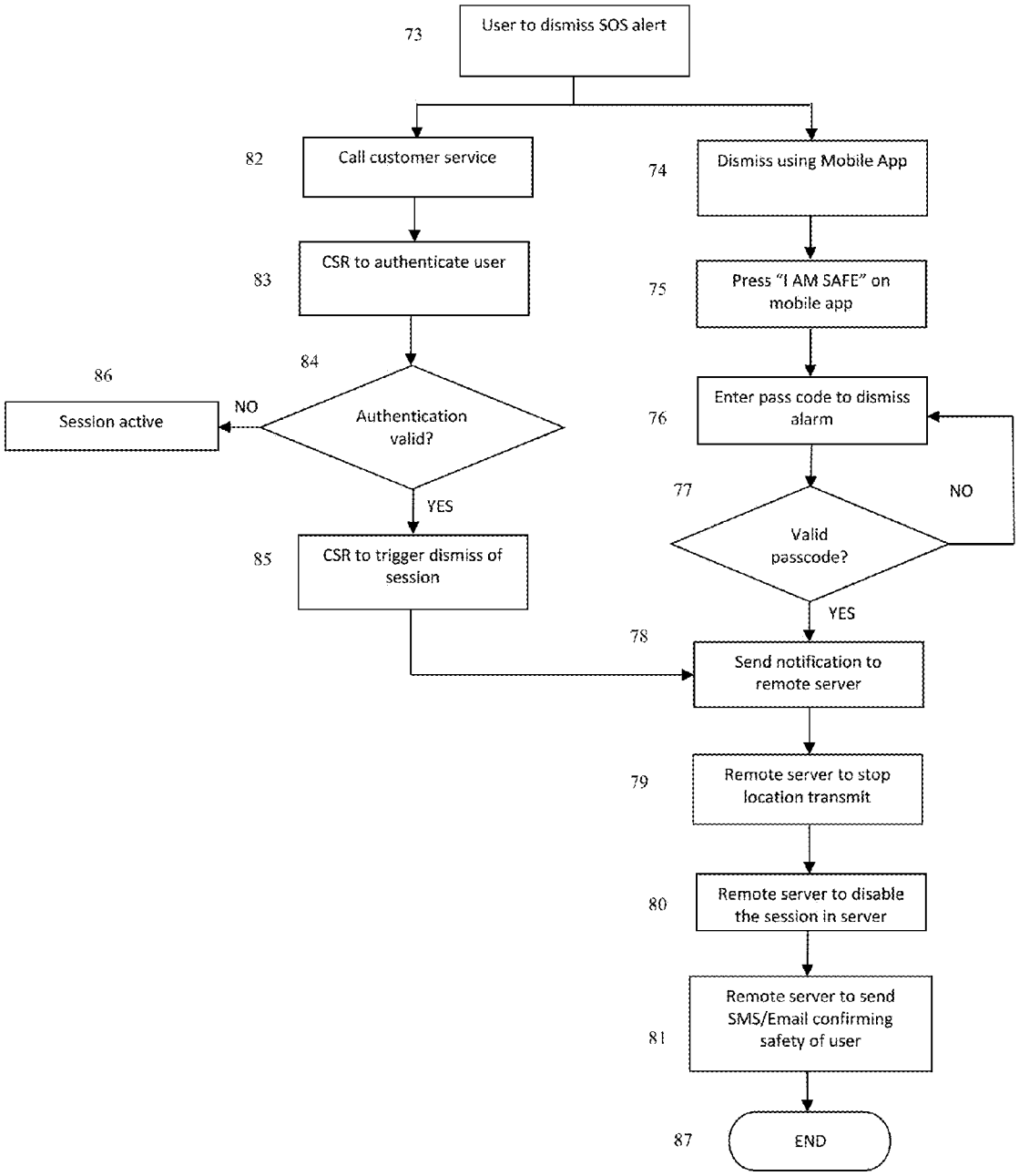
FIG. 6 shows the process of dismissal of the SOS triggered during an emergency.

FIG. 6 shows the process of dismissal of the SOS triggered during an emergency. The user after being saved from the emergency situation can dismiss the SOS to prevent their well-wishers getting panic and confirm safety. The dismissal 73 can be done either through a Call-center 82 or a Mobile application 74. The user initiates a call to the Customer service 82, and the Customer Service Representative takes the authentication details 83. The session remains active 86 for invalid authentication. If the authentication is a success, then the CSR triggers a dismissal of session 85 by sending the notification to the Remote Server 78. The Remote Server then stops transmitting of the Location 79 and disable the session 80. Also, the Remote Server sends an SMS and E-mail to the Registered users 81 and to those whom earlier the alert signal was forwarded, confirming the safety of the affected user.

In the Mobile application, the "I am Safe" option has to be selected 75 to dismiss the SOS alert initiated. A passcode is required to enable the dismissal 76. The process of dismissing the safety alert could not be started until a valid passcode is entered 77. Further, the process continues by sending the notification to the Remote Server 78 which stops the transmitting of the Location 79 and disables the session in the Remove Server. An SMS and e-mail are initiated by the Remote Server to all those who were alerted earlier to inform about the safety of the affected user.

The wearable device allows the user to pre-configure Gestures to control any electronic device such as a Mobile phone, media player, VR controllers, laptop, etc. For instance, the user may define Gestures to control media player, to control slides of power point presentation, or to answer and to reject phone calls or to act as a computer mouse using the Bluetooth module of the present invention.

What is claimed is:

1. A precise, gesture-based, safety monitoring wearable device for a user having, (a) a cover, (b) side keys, (c) a laser etching, (d) a heart-rate monitor, (e) a charging port, (f) a controller, (g) a mobile device, (h) a Remote Server, (i) a battery, (j) an SOS battery, (k) distress signal, (l) a light emitting diode (LED), (m) a vibration motor, (n) 9-axis inertial measurement unit (IMU), (o) one or more alert signals, (p) a Bluetooth module and, (q) a processor, wherein:

a) the cover is located on top front portion;

b) the laser etching, the heart-rate monitor and the charging port are on the backside of the wearable device;

c) the battery is molded into a design for maximum safety;

d) the SOS battery reserve is used to send the distress signal;

e) the light emitting diode has a TFT display screen to display time under normal operating conditions;

f) the vibration motor is located away from the 9-axis inertial measurement unit and is configured as a silent alarm using a vibration module such that the motor configured to vibrate upon generation of a distress gesture to indicate to a user that the alert signal has been sent to registered emergency numbers of the user;

g) the alert signal from the user is in the form of gestures, and the IMU is utilized to get 3D position and orientation of the wearable device that aids in extracting meaningful gestures;

h) the controller is a microcontroller configured for storing necessary instructions required for generating distress signal and for transmitting an alert signal along with location information of the user to the remote server and it co-ordinates various modules in the wearable device and initiates different modules based on the gestures recognized by the IMU, and executes necessary actions including gesture recognition, configuration, communication and storage; and i) the IMU acts as a high accuracy motion tracking unit to recognize gestures and is of small size with low power consumption, and comprises a 3-axis accelerometer, 3-axis gyroscope, and 3-axis magnetometer, each with 9 degrees of freedom, wherein:

i) hand gestures are tracked by the 3-axis accelerometer and gyroscope from which alphabets are created for the gestures, each alphabet represents a particular action and each action is configured by the user using either the Bluetooth or a web-based application;

ii) the 3-axis accelerometer measures acceleration of the user, whereas, the 3-axis magnetometer measures magnetic field associated with the user's change of orientation;

iii) the 3-axis gyroscope is used along with the 3-axis accelerometer for more precise determination of an orientation of the user;

iv) the 9-axis inertial measurement unit automatically identifies a type of distress by calculating the change of orientation of the user from the 3-axis accelerometer, the 3-axis gyroscope, and the 3-axis magnetometer; and v) to reduce false activations which might be performed while performing daily activities, an activation gesture is performed by the user to activate the actual gestures pre-configured by the user.

2. The device of claim 1, wherein the device contains an OLED display and an LED display.

3. The device of claim 1, wherein the wearable device allows the user to pre-configure one or more gestures such that:

a) the user can configure gestures in an x-y plane, x-z plane and also with varying angular velocities, wherein, upon detection of a gesture hit in the x-y plane, x-z plane, or with varied angular velocity pre-configured by the user, the controller activates action associated with the pre-configured gesture set by the user.

4. A gesture-based system having (a) a wearable A comprising a wearable and a mobile application, (b) location services B comprising location services and a location processor, (c) services C comprising a redis cluster, an application gateway, user services, health services and safety services, and (d) customer services D, comprising a customer service relationship (CSR) office, website, CSR services with site-to-site (STS) VPN and a load balancer, with data processing apparatus programmed to perform precise safety monitoring operations comprising:

a) detecting one or more user inputs from the wearable A and performing measurements;

b) triggering one or more SOS signals based on the user input;

c) communicating between the wearable A and services C;

d) initiating the SOS after eliminating false alarms; and e) detecting a user's location and contacting safety services and responding in real-time;

wherein the wearable A comprises:

a) a cover;

b) side keys;

c) a laser etching;

d) a heart-rate monitor;

e) a charging port;

f) a controller;

g) a mobile device;

h) a remote server;

i) a battery;

j) an SOS battery;

k) distress signal;

l) a display screen;

m) a vibration motor;

n) 9-axis inertial measurement unit (IMU);

o) one or more alert signals;

p) a Bluetooth module; and q) a processor, wherein the vibration motor is located away from the 9-axis inertial measurement unit and is configured as a silent alarm using a vibration module such that the motor configured to vibrate upon generation of a distress gesture to indicate to the user that the alert signal has been sent to registered emergency numbers of the user, wherein the one or more alert signals from the user is in the form of gestures, and the IMU is utilized to get 3D position and orientation of the wearable device that aids in extracting meaningful gestures;

wherein the IMU acts as a high accuracy motion tracking unit to recognize gestures and is of small size with low power consumption, comprises of a 3-axis accelerometer, 3-axis gyroscope, and 3-axis magnetometer, thus with 9 degrees of freedom, wherein:

i) hand gestures are tracked by the 3-axis accelerometer and gyroscope from which alphabets are created for the gestures, each alphabet represents a particular action and configured by the user using either the Bluetooth or a web-based application;

ii) the 3-axis accelerometer measures acceleration of the user, whereas, the 3-axis magnetometer measures magnetic field associated with the user's change of orientation;

iii) the 3-axis gyroscope along with the 3-axis accelerometer is utilized for precise determination of an orientation of the user;

iv) the 9-axis inertial measurement unit automatically identifies a type of distress by calculating the change of orientation of the user from the 3-axis accelerometer, the 3-axis gyroscope, and the 3-axis magnetometer; and v) to reduce false activations which might be performed while performing daily activities, an activation gesture is performed by the user to activate the actual gestures pre-configured by the user;

wherein the controller is a microcontroller which is capable of storing necessary instructions required for generating distress signal and for transmitting an alert signal along with location information of the user to the remote server, and the controller co-ordinates various modules in the wearable device and initiates different modules based on the gestures recognized by the IMU, and executes necessary actions including gesture recognition, configuration, communication and storage; and wherein the display screen is either a light-emitting diode (LED) screen or an organic light-emitting diode (OLED) or liquid crystal display (LCD), used to indicate information and notifications.

5. The system of claim 4, further comprising (a) service bus queues, (b) a SQL database, (c) solr search engine, (d) mongo database, (e) telephony services, (f) notification services, and (g) one or more load balancers, wherein:

a) the SQL database feeds user data configured as the registered wellwisher's details and local emergency contacts, to enable an efficient system performance;

b) the solr search engine and redis cluster are assimilated into the system;

c) the services requested are lined-up and processed by the service bus queues;

d) the telephony services and notification services which can be used by a user accordingly as and when required either to alert their network members or to dismiss the alert signal generated during an emergency; and e) dismissal of an SOS triggered during an emergency is done through either a Call-center or a Mobile application, which will be dealt with the CSR office.

6. The system of claim 4, wherein the wearable A allows the user to pre-configure one or more gestures such that:

a) the user can configure gestures in an x-y plane, x-z plane, and also with varying angular velocities, wherein, upon detection of a gesture hit in the x-y plane, x-z plane, or with varied angular velocity, pre-configured by the user, the controller activates action associated with the pre-configured gesture set by the user.

7. A computer-implemented method comprising the steps of:

a) detecting one or more user input from a wearable device including (a) button press, (b) force detection, (c) auto-accident collision detection, (d) stress and fatigue detection, and (e) hand gestures;

b) performing one or more measurements based on a user's input by detecting a button press, enabling force detection, measuring inertial measurement unit (IMU) sensor data, and detecting patterns from hand gestures;

c) triggering SOS based on the user input;

d) communicating between the wearable device and a remote server;

e) initiating the SOS by the remote server;

f) verifying a false alarm;

g) calculating location and contacting emergency services; and h) dismissing the SOS triggered by the user, wherein the step of performing measurements further comprises:

a) for a button press input:
  i) pressing a SOS button present in the wearable device;
  ii) verifying a period of button press by the controller, further:
    A) pressing the button for longer than one second vibrates the wearable and triggers the SOS and;
    B) pressing the button for a period less than one second, awaits SOS button press again;
b) for a force detection:
  i) enabling force detection;
  ii) triggering a proximity sensor upon enabling the force detection;
  iii) measuring proximity value by the proximity sensor and checking a position of the wearable device;
  iv) vibrating the wearable device and initiating of the SOS, if the wearable device is not attached to a user's wrist; and
  v) monitoring proximity value and attachment of the wearable device to the wrist, in the case of the wearable device safely attached to the user's wrist;
c) for an auto-accident collision detection:
  i) enabling force detection;
  ii) measuring G-force value from a sensor on receiving the user input;
  iii) enabling vibrate mode of the wearable device thus initiating the SOS once the G-Force value exceeds a threshold value; and
  iv) non-initiating the action for G-force value lesser than the threshold value;
d) for a stress and fatigue detection:
  i) measuring an IMU sensor data on detection of the fall of a user;
  ii) measuring the proximity if there is a fall detected, else step 'i' is repeated;
  iii) measuring the heart rate monitor (HRM) data if the wearable is attached to the wrist else no action is taken;
  iv) vibrating the wearable if the HRM data is not stable and initiating the SOS, else starting the timer for sixty seconds and if moving of the user is detected, then no action is taken; and
  v) moving of the user when not detected, wearable is vibrated and initiating the SOS; and
e) for hand gestures:
  i) oscillating of hand by the user for a configurable number of times continuously, and detecting a pattern of hand gesture by the wearable device;
  ii) comparing a pattern detected by the sensor with a user-defined pattern which are pre-defined by the user; and
  iii) vibrating the wearable and sending notifications to raise SOS, if the pattern of hand gesture is valid, else no action is taken.

8. The method of claim 7, wherein the step of communicating between the wearable device and the remote server further comprises:
a) receiving an SOS by the wearable device;
b) transmitting the signals to remote server via cellular network to a mobile device, when the wearable has connectivity;
c) saving the SOS and waiting till connectivity is back, when no connectivity in wearable device;
d) if a mobile device is present in the system then,
  i) receiving an SOS by the wearable device;
  ii) transmitting the signals to the remote server through the mobile device, when the wearable has connectivity; and
  iii) saving the SOS and waiting till connectivity is back, when no connectivity in wearable device;
e) receiving the signals by the remote server; and
f) initiating the SOS by the remove server.

9. The method of claim 7, wherein the step of verifying a false alarm further comprises:
a) checking the user's preferences by the controller;
b) verifying the false alarm before raising the SOS based on a user's preference provided, initiating a call back to the user, before proceeding to the next step 'c';
c) confirming SOS situation by the controller to the remote server to send let or long every Q seconds to the remote server, if there is no false alarm.

10. The method of claim 7, wherein the step of calculating location and contacting emergency services further comprises:
a) creating a dynamic URL by the remote server to track the user;
b) calculating the nearest R users within S meters radius of the proximity from an incident Location by the remote server; and
c) sending the alert signals by the remote server to well-wishers, nearest R users, and emergency services.

11. The method of claim 7, wherein the step of dismissing the SOS signals further comprises:
a) confirming the information to the well-wishers, even when the user is fine, then the user dismiss the SOS alert; and
b) initiating the dismissal of SOS either by calling the customer service or by using the mobile application, after taking user input as follows:
  i) dismissal of SOS by calling the customer service:
    A) initiating a call to a customer service by the user and providing authentication details to a customer service representative (CSR), a session remains active for invalid authentication;
    B) triggering a dismissal of the session by the CSR by sending a notification to the remote server upon successful authentication, thus ending transmission of the location and disabling the session in the remote server; and
    C) sending an SMS and e-mail by the remote server to the user and to those whom earlier the alert signal was forwarded, confirming the safety of the affected user and ending the process; and
  ii) dismissal of SOS through the mobile application:
    A) selecting an "I am Safe" option in the mobile application to dismiss the SOS alert initiated, that requires entering a passcode to enable, the dismissal configured to not be initiated until a valid passcode is provided;
    B) sending a notification to the remote server which stops to transmit the location and disables the session in the remote server; and
    C) initiating an SMS and e-mail by the remote server to all those who were alerted in the method to inform about the safety of the affected user and ending the process.

12. The method of claim 7, wherein a process of the triggered SOS signal to protect an affected user further comprises:
a) communicating with the remote server by the wearable device:
  i) receiving the SOS at the wearable device and forwarding the same to the remove server via cellular network if wearable has connectivity;

ii) if no connectivity in the wearable then saving the SOS and waiting till the connectivity is back;

iii) if a mobile device is present in the system, then:

A) receiving the SOS at the wearable device and forwarding the same to the remote server through the mobile device if wearable has connectivity; and B) if no connectivity in the wearable then saving the SOS and waiting till the connectivity is back; and iv) receiving signals by the remote server and initiating the SOS;

b) triggering of SOS to process the alert signal;

c) verifying for false alarm by the controller:

i) checking the user's preference provided for "verify for false alarm before raising SOS";

ii) confirming the SOS situation to the remote server directly if the user does not prefer for any verification, else further comprises:

A) initiating IVR call to check false SOS for a configurable number of times if not answered for first time;

B) prompting the user to enter a passcode if the call is answered to ensure that the user is in real trouble, a valid passcode indicates no harm to the user, and hence the process ends ignoring the SOS trigger; and C) confirming the SOS situation to the remote server for an invalid passcode entry; and iii) forwarding SOS notification to the remote server and sending either a let or long every configurable second to the remote server continuously;

d) calculating the Location and contacting of emergency services:

i) creating a dynamic URL by the remote server to track the user and, also calculating the nearest R configurable users within configurable meters radius of proximity from the incident location;

ii) sending an alert signal by the remote server to registered wellwishers and nearest R users in a network and local emergency services, the remote server sends only basic details but not entire details while alerting nearest R users if they are not part of the affected user's network, to avoid any unnecessary trouble to the user during an emergency or later;

iii) refreshing the location by the remote server based on the input received from the wearable device time-to-time; and iv) identifying the network type of the users as 3G, 4G, Edge or SMS by the Remote Server to forward the details:

A) forwarding real-time Location for 3G, 4G users, and 2G users receiving the location with slow refresh;

B) receiving of SMS Location for users without 3G, 4G and 2G, which undergoes cell triangulation and showing the nearest proximity based on available cell tower; and C) monitoring continuously for the signal of those users who do not come under any of the above-mentioned network facility to whom the location could not be shared, on identifying the signal performs a check for network identification and forwarding the details accordingly.

13. The method of claim 7, wherein the wearable device allows the user to pre-configure one or more gestures such that:

a) the user can configure gestures in an x-y plane, x-z plane, and also with varying angular velocities, wherein, upon detection of a gesture hit in the x-y plane, x-z plane, or with varied angular velocity, pre-configured by the user, the controller activates action associated with the pre-configured gesture set by the user.

* * * * *